US008875634B2

(12) United States Patent
Gibson et al.

(10) Patent No.: US 8,875,634 B2
(45) Date of Patent: Nov. 4, 2014

(54) AERODYNAMIC PROJECTILE

(75) Inventors: Gary E. Gibson, Riverwoods, IL (US); Michael A. Varacins, Burlington, WI (US)

(73) Assignee: PC IP Group, LLC, Lake Forest, IL (US)

( * ) Notice: Subject to any disclaimer, the term of this patent is extended or adjusted under 35 U.S.C. 154(b) by 156 days.

(21) Appl. No.: 12/317,868

(22) Filed: Dec. 29, 2008

(65) Prior Publication Data

US 2012/0199034 A1 Aug. 9, 2012

(51) Int. Cl.
*F42B 12/00* (2006.01)
*F42B 10/06* (2006.01)
*F42B 12/40* (2006.01)

(52) U.S. Cl.
CPC ..... *F42B 10/06* (2013.01); *F42B 12/40* (2013.01)
USPC ..... 102/502; 102/513

(58) Field of Classification Search
USPC ..... 102/501, 502, 513, 529
See application file for complete search history.

(56) References Cited

U.S. PATENT DOCUMENTS

| | | | | |
|---|---|---|---|---|
| 6,223,658 | B1 * | 5/2001 | Rosa et al. | 102/501 |
| 6,230,630 | B1 * | 5/2001 | Gibson et al. | 102/513 |
| 6,615,739 | B2 * | 9/2003 | Gibson et al. | 102/513 |
| 7,228,802 | B2 * | 6/2007 | Montefusco | 102/529 |
| 7,526,998 | B2 * | 5/2009 | Vasel et al. | 102/502 |
| 8,261,665 | B1 * | 9/2012 | Walsh | 102/498 |
| 2006/0254453 | A1 * | 11/2006 | Leal et al. | 102/513 |
| 2009/0126602 | A1 * | 5/2009 | Murphy et al. | 106/251 |
| 2009/0266262 | A1 * | 10/2009 | Vasel et al. | 102/370 |

* cited by examiner

*Primary Examiner* — Gabriel Klein
(74) *Attorney, Agent, or Firm* — McDermott Will & Emery LLP

(57) ABSTRACT

An aerodynamic projectile is provided having a shell with an aerodynamic structure and a controlled center of gravity, and which exhibits improved aerodynamics and resulting accuracy, and which is suitable for less lethal uses. The projectile shell has a closed front cavity housing a payload, such as a marking agent, therein. The projectile shell also has an open rear portion to provide access to the open rear cavity, and to decrease the weight of the projectile and appropriately locate the center of gravity. The projectile shell also includes a plurality of fins on a sidewall member to enhance the accuracy of the projectile.

23 Claims, 2 Drawing Sheets

FIG. 5

AERODYNAMIC PROJECTILE

CROSS-REFERENCE TO RELATED APPLICATIONS

Not applicable.

FEDERALLY SPONSORED RESEARCH OR DEVELOPMENT

Not Applicable.

TECHNICAL FIELD

The present invention relates generally to aerodynamic projectiles, and more particularly to aerodynamic projectiles having a closed front cavity and an open rear cavity, and which are suitable for non-lethal uses.

BACKGROUND OF THE INVENTION

A variety of non-lethal projectiles are known in the prior art. One type of non-lethal projectile is a rubber bullet that is typically used for the purpose of riot control. Rubber bullets, however, have their drawbacks. For example, rubber bullets can penetrate the skin causing severe injury to the target. Additionally, rubber bullets are poor projectiles for marking a target.

Another type of non-lethal projectile is a paint ball. Paint balls are typically used for purposes of marking, such as to mark individuals for future identification without causing injury. Such non-lethal projectiles are used by sportsmen, police, military and other security forces to mark targeted persons, such as those participating in mock war games and other training exercises. Typically, paint balls have a water soluble outer shell, such as a gelatinous material, which allow the shell to safely disintegrate over time when subject to typical environmental conditions. However, such paint balls have several drawbacks. For example, because the typical paint ball is made of a gelatinous material it cannot be filled with a wide variety of components, such as aqueous pigments and/or dyes.

Because of this and other drawbacks, the Assignees of the present invention developed paint ball projectiles made of a plastic, such as polystyrene, which fracture in a predetermined pattern upon impact with a target. U.S. Pat. Nos. 5,254,379 and 5,639,526 (the disclosures of which are incorporated herein by reference in their entirety) provide a plastic paint ball constructed of a linear polymer of sufficient strength to transport, load, and fire out of a compressed gas gun, which is molecularly oriented such that upon application of a force at any impact point on the paint ball shell, the shell fractures in a way that greatly reduces the risk of injury. Further, because the plastic paint ball is not water soluble like a gelatinous one, it is not sensitive to the environment and can be filled with a wide variety of components, including aqueous pigments and/or dyes, powders and solids. While such plastic paint balls effectively mark a target without injury and do not have the drawback of limiting the type of material that can be carried in the paint ball, they may not adequately stun or immobilize a target, as is needed for the purpose of riot control.

More importantly, traditional paint balls, whether the shell is formed from gelatin or plastic, suffer from inaccuracy, especially when launched from a distance greater than 100 feet from the target. This inaccuracy is due, in part, to the spherical shape and smooth surface of the paint ball projectile. The spherical shape creates an irregular, turbulent flow around the projectile causing an unstable flight pattern. Also, when a smooth-surfaced paint ball is fired from a smooth, uniform-bore barrel, the result is a ball generally without spin, which behaves unpredictably. Additionally, due to inherent manufacturing difficulties, most paint ball projectiles are not perfectly spherical. For example, gelatinous paint balls tend to be up to 0.015" out of round. While plastic shells are usually only about 0.002" out of round, even this seemingly small oblong shape imparts inaccuracy to the fired paint ball projectile.

Another problem is that the effective range of current paint ball projectiles is very limited. This is because paint balls are typically large projectiles, are not very dense, have a spherical shape and are fired at low muzzle velocities, all of which creates a substantial amount of drag in comparison to the momentum provided to the paint ball upon firing with a compressed gas gun.

In order to solve the problem of non-lethal projectiles to be used for riot control the Assignees of the present invention developed a dual cavity projectile as shown in U.S. Pat. Nos. 6,230,630 and 6,615,739, the disclosure of both being incorporated herein by reference and made a part hereof. The projectiles disclosed in the '630 and '739 patents comprise a first front enclosed cavity in a generally hemispherical portion, and a second rear closed cavity in a generally cylindrical portion. The hemispherical portion has a wall with an inner surface and an outer surface wherein the inner surface forms a hemispheric interior volume, and the cylindrical portion has a wall with an inner surface and an outer surface to form a second interior hemispherical volume having the same general shape and volume as the interior volume of the front hemispherical portion. The two closed cavities operate as the single closed cavity of the traditional round paintball. Accordingly, these projectiles require a bottom wall on the cylindrical portion. The bottom wall operates as a portion of the inner and outer surface of the second interior volume. Typically, in these inventions the front hemispherical closed cavity carries a weighing agent, such as a metal or metal alloy. The metal weighting agent is preferably non-toxic and not environmentally hazardous, such as bismuth. Bismuth weighting agents are non-toxic, pose low risks to the environment, and may be preferred where such considerations are important. The rear hemispherical closed cavity preferably carries a marking agent, or an immobilizing agent, or a combination of a marking agent and an immobilizing agent. Marking agents generally comprise liquid pigments and/or dyes, powder pigments and/or dyes, water soluble pigments and/or dyes, permanent pigments and/or dyes, infra red pigments and/or dyes, ultra violet pigments and/or dyes, pigments and/or dyes that glow in the dark (e.g., a chemiluminescent pigment and/or dye or a phosphorescent pigment and/or dye), and miniature radiotransmitters. Immobilizing agents are used to immobilize a target struck by the projectile. Examples of immobilizing components include liquid irritants, powder irritants, gaseous irritants, pepper powders, tear gas, malodorants, and other noxious chemicals. However, the inventions of the '630 and '739 patents require a dual cavity and a rear bottom wall that closes the rear cavity. As a result, these projectiles are heavy and more costly.

Thus, there remains a need for an inexpensive single cavity projectile that is both lightweight and effective in marking and/or immobilizing a target, and which provides greater accuracy than traditional paint balls for recreational play. The present invention seeks to overcome certain of these limitations and other drawbacks of the prior art, and to provide new features not heretofore available for recreational play. A full discussion of the features and advantages of the present invention is deferred to the following detailed description, which proceeds with reference to the accompanying drawings.

SUMMARY OF THE INVENTION

The present invention generally provides an improved aerodynamic projectile for recreational play for delivering a marking agent in a projectile. The projectile generally comprises a shell housing a fill material.

According to one embodiment, the shell comprises a generally hemispherical member in a first portion of the projectile, a sidewall member in a second portion of the projectile, and a cross member therebetween. In one embodiment the cross member is integral with the sidewall member, and the generally hemispherical member is fixedly connected to the sidewall member. The shell also has a front closed cavity and a rear open cavity. The fill material is provided in the front closed cavity.

According to another embodiment, the generally hemispherical member has an outer surface and an inner surface. The inner surface of the generally hemispherical member and a first surface of the cross member define the closed cavity having an interior volume.

According to another embodiment, the sidewall member has an inner surface and an outer surface, and a first end and a second end. The inner surface of the sidewall member and a second surface of the cross member form the rear open cavity opposing the front closed cavity of the generally hemispherical member. The rear open cavity is generally open at the second end of the sidewall and assists in decreasing the weight of the shell to assist in maintaining the center of gravity of the projectile in front of the center of pressure of the projectile during the flight of the projectile. One means to maintain the center of gravity in front of the center of pressure during flight of the projectile is the have the proper ration of shell weight and fill weight. The sidewall member may comprise a variety of geometric configurations, such as cylindrical or frustoconical.

According to another embodiment, a plurality of fins extend from the outer surface of the sidewall member. In such an embodiment the radially extending fins preferably provide a generally outer cylindrical circumference for the sidewall member having approximately the same diameter as the generally hemispherical member. In one embodiment the fins are orientated at an angle to a plane of the sidewall member. In another embodiment the fins exhibit a curvature around the outer surface of the hollow sidewall member. Such curvature imparts a spinning motion to the projectile as it flies through the air, and the spinning motion imparts added stability and accuracy to the projectile when fired, thereby increasing the probability of hitting the intended target.

According to yet another embodiment, a payload or fill material is located within the closed cavity of the generally hemispherical member. In one embodiment the fill material contains a marking component. In a preferred embodiment the fill material has a density of approximately 16 to 17 lb/gallon of fill material; in an alternate preferred embodiment the fill material has a density of approximately at least 15 lb/gallon; and, in another preferred embodiment the fill material has a density of greater than 10 lb/gallon. Conversely, typical paintball paint, such as polyethylene glycol, has a density of approximately 8 lb/gallon. Such heavier fill material densities in combination with the weight of the shell of the projectile assist in maintaining the center of gravity of the projectile in front of the center of pressure of the projectile during flight of the projectile, and also assist in allowing a lightweight and inexpensive projectile to have an extremely accurate flight.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
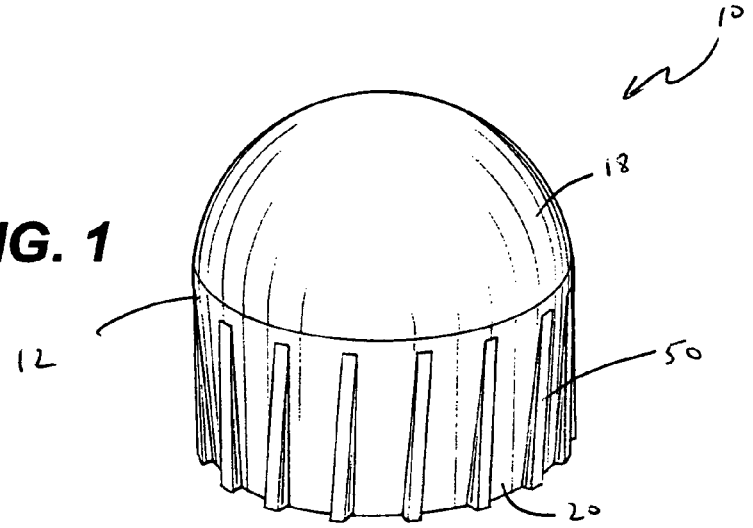
FIG. 1 is a top perspective view of one embodiment of an aerodynamic projectile having a front closed cavity and a rear open cavity.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the Figures, and specifically to FIGS. 1-4, there is shown an aerodynamic projectile 10 for carrying a payload, and which is suitable for less lethal uses, including recreational play. The aerodynamic projectile 10 generally comprises a shell 12 having a first front closed cavity 14 and a second open rear cavity 16. Preferably, the shell 12 of the aerodynamic projectile 10 fractures upon impact and is used to mark a target. In one embodiment the projectile 10 may be fired from generally available compressed gas guns such as paint ball guns. Accordingly, in one embodiment the projectile 10 preferably has a maximum diameter of about 0.690 inches, the diameter of a typical paint ball.

In one embodiment the shell 12 comprises a generally hemispherical member 18 in an first portion of the projectile 10, a sidewall member 20 in a second portion of the projectile 10, and a cross member 22 between the hemispherical member 18 and the sidewall member 20. To accommodate a variety of materials that may be carried by the projectile 10, such as water or a water-based marking agent, preferably the shell 12 is made from a plastic material which, preferably does not present a projectile that develops a lethal force. To simplify manufacturing and to permit easy joining of the hemispherical member 18 to the sidewall member 20, the two components are preferably manufactured from the same material.

For instance, the shell 12 may be made according to U.S. Pat. Nos. 5,254,379 and 5,639,526. Such a shell 12 is resistant to moisture, of sufficient strength to permit manufacture of the desired projectile 10 and yet at the same time presents a readily frangible leading surface permitting ready marking of the individual struck by the projectile in a less lethal manner.

One suitable plastic for use in manufacturing the shell 12 is a polystyrene marketed under the tradename Novacor and distributed by Polymerland, Inc. This polystyrene is a linear polymer which yields a hemispherical portion that is substantially impervious to water and does not dissolve when contacted by rain or sweat or when placed in a warm humid environment. This impervious nature allows the shell to be used to contain a variety of products including water, smoke, tear gas, powders gels, irritant substances and other items unsuitable for placement in known gelatin shells. The shell 12 may be formed from a linear polymer in several ways including injection molding and blow molding. However, the preferred method of forming the shell 12 of the invention is by injection molding of a linear thermoplastic polymer. In injection molding, the thermoplastic polymer is heated and then injected under high pressures into a mold. Using injection molding, the shell 12, and specifically, the generally hemispherical portion 18 of the shell 12 may have a thinner, more uniform wall structure.

Figure 4:
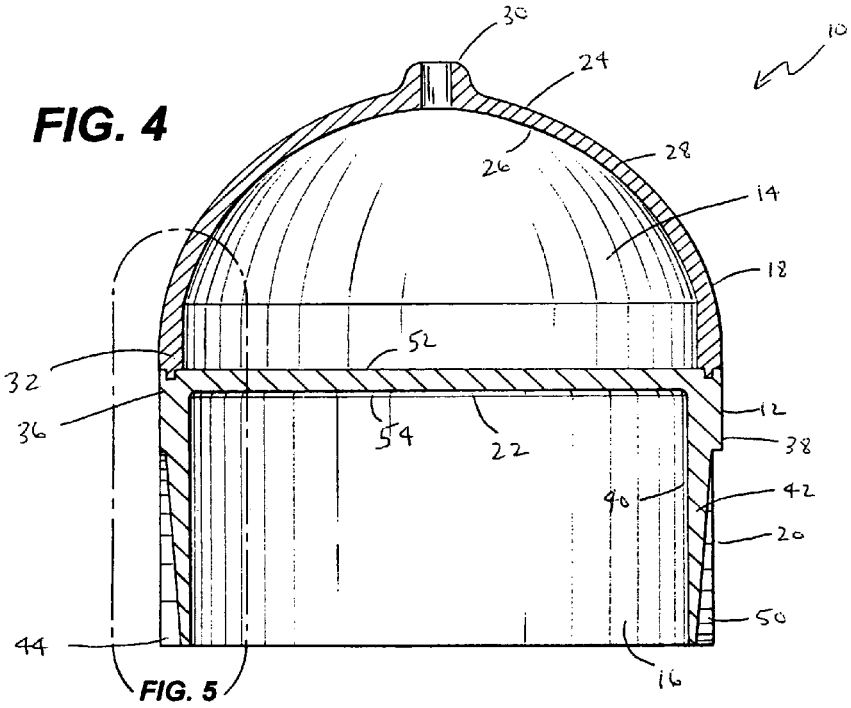
FIG. 4 is a cross-sectional view about lines 4-4 of FIG. 3.
Figure 6:
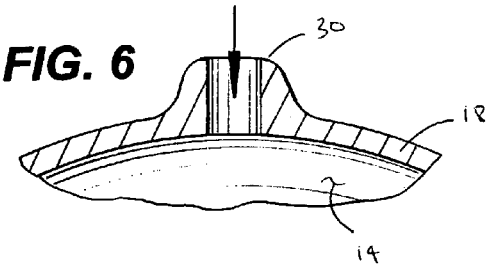
FIG. 6 is a partial cross-sectional view of the fill-port for the closed cavity of an aerodynamic projectile prior to filling of the closed cavity.
Figure 7:
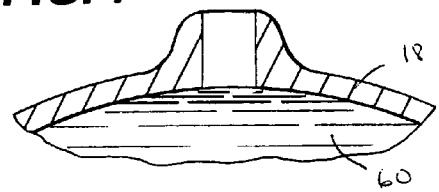
FIG. 7 is a partial cross-sectional view of the fill-port for the closed cavity of an aerodynamic projectile following the closed cavity being filled; and, FIG. 8 is a partial cross-sectional view of the closed cavity of an aerodynamic projectile following the fill port being heat sealed.
Figure 8:
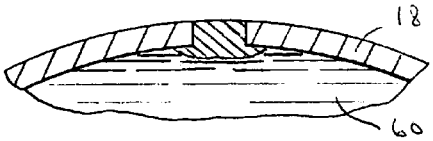

As shown in FIG. 4, the generally hemispherical member 18 has an outer surface 24 and an inner surface 26 which forms a wall 28. In one embodiment, the thickness of the wall 28 is approximately 0.005" to about 0.040", and preferably approximately 0.015". Additionally, in a preferred embodiment, the outer diameter of the generally hemispherical member 18 is approximately 0.684". A fill hole or port opening 30 extends through the wall 28 of the hemispherical member 18, from the inner surface 26 through to the outer surface 24. As shown in FIG. 6, the port opening 30 provides access to the front closed cavity 14 for filling of the cavity 14 with the payload, as is explained herein, after the hemispherical member 18 is connected to the sidewall member 20, and the cross member 22 is positioned between the hemispherical member 18 and the sidewall member 20, thereby creating the front closed cavity 14. After introduction of the fill material or payload into the front closed cavity 14 through the fill hole 30, the fill hole 30 is sealed as shown in FIG. 7, and the fill hole 30 is then ground and polished smooth, as shown in FIG. 8, presenting a generally smooth surface for the projectile 10 in the region of the fill hole 30.

Figure 5:
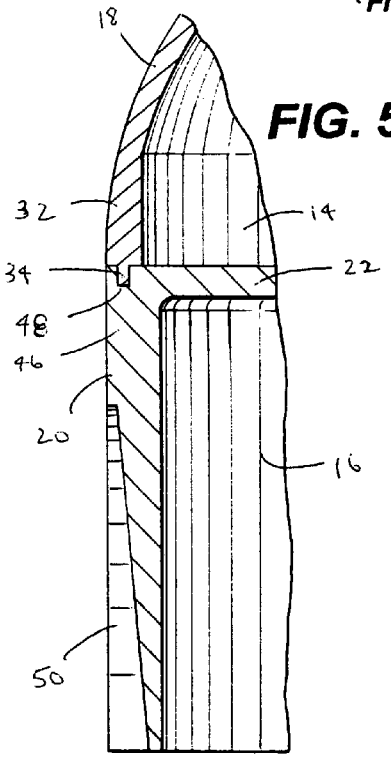
FIG. 5 is a partial enlarged view of the joint between the generally hemispherical member, the sidewall member and the cross-member of one embodiment of an aerodynamic projectile.

As shown in FIGS. 4 and 5, in one embodiment the wall 28 of the generally hemispherical member 18 has a rim 32 which may be shaped in a variety of known patterns that permit the joining of the hemispherical member 18 to the sidewall member 20. The shape of the rim 32 is determined to some extent by the manner in which the cylindrical and hemispherical portions are to be joined, i.e., by solvent welding, ultrasonic welding, etc. A preferred rim 32 shape is illustrated at FIG. 5. In such a configuration an annular rib or tongue 34 is provided at an end of the rim 32. The preferred annular rib 34 is approximately 0.012" in height, and approximately 0.014" thick. This rim profile is created to match with the rim profile at a first end 36 of the sidewall member 20, and is especially suitable when using ultrasonic or solvent welding to connect the hemispherical member 18 to the sidewall member 20.

Referring to FIG. 1-5, the sidewall member 20 has an outer surface 38 and an inner surface 40 defining a wall 42 of the sidewall member 20. The sidewall member 20 also has a first end 36 and a second end 44. In one embodiment, the length of the sidewall member 20 from the first end 36 to the second end 44 is approximately 0.348" (including the thickness of the cross member 22), which is approximately equal to the radius of the generally horizontal member 18. Preferably, the thickness of the wall 42 of the sidewall member 20 is approximately 0.015" to about 0.050", and varies at different locations on the same component. As explained above, the sidewall member 20 has a rim 46 at the first end 36 of the sidewall member 20 with structure to mate the sidewall member 20 with the rim 32 of the generally hemispherical member 18. Referring to FIG. 5, in a preferred embodiment the structure of the rim 46 of the sidewall member 20 comprises an annular groove 48 extending inwardly from a top surface of the rim 46 of the sidewall member 20 to accept and mate with the annular rib 34 extending from the rim 32 of the generally hemispherical member 18.

In one embodiment the sidewall member 20 is generally cylindrical in shape (further in one embodiment with the first end 36 being closed by the divider or cross member 22, and the second end 44 being open). In another preferred embodiment the sidewall member 20 has a slightly frustoconical shape, with the first end 36 having a larger diameter than the second end 44. In this embodiment the first end 36 may be similarly closed by the cross member 22, and the second end 44 may be open. In yet another embodiment the cross-sectional dimension of the outer surface of the sidewall member 20 is less than the outer diameter of the generally hemispherical member 18. In most preferred embodiments the sidewall member 20 is hollow because the second end 44 is open, providing access to the second open rear cavity 16, as explained herein. In another embodiment the diameter of the generally hemispherical member 18 is approximately equal to the diameter of the largest portion of the sidewall member 20. Further, in another embodiment, the radius of the generally hemispherical member 18 is approximately equal to the length from the first end 36 to the second end 44 of the sidewall member 20.

In one embodiment the shell 12 also has a plurality of protrusions 50 extending from the outer surface 38 of the wall 42 of the sidewall member 20. The protrusions 50 may be fins 50. The protrusions 50 assist to promote a stable accurate flight of the projectile 10. In one embodiment the fins 50 exhibit a curvature around the outer surface 38 of the hollow sidewall member 20. Such curvature imparts a spinning motion to the projectile 10 as it flies through the air, and the spinning motion imparts added stability and accuracy to the projectile when fired, thereby increasing the probability of hitting the intended target.

Preferably, there are at least three fins 50, more preferably at least eight fins 50 and, even more preferably, there are sixteen fins 50 symmetrically spaced around the outer surface 38 of the sidewall member 20. In one embodiment the width of the fins 50 is approximately 0.032", however, they may be wider or narrower as required for the appropriate flight characteristics. In one embodiment, as shown in the figures, the fins 50 preferably extend from a sidewall member 20 that is generally frustoconical in shape, as explained above, or which has a smaller radius for its outside diameter than the radius of the generally hemispherical member 18. The fins 50 extend from the second end 44 of the sidewall member 20 toward the first end 36 of the sidewall member 20. The surface of the fins 50 protrude beyond the outer surface 38 of the hollow sidewall member 20, beginning initially at zero proximal the first end 36 of the sidewall member 20 and increasing gradually as the fins 50 traverse toward the second end 44 of the sidewall member 20 along the length of the sidewall member 20 (in such an embodiment where the outside diameter of the sidewall member 20 decreases from the first end to the second end due to the frustoconical shape of the sidewall member 20) such that the overall diameter of the finned sidewall member 20 (at the largest radial point of the fins 50) is about equal to the outside diameter of the hemispherical member 18, preferably about the entire length of the sidewall member 20. For example, in such an embodiment at the second end 44 of the sidewall member 20 the fins 50 preferably extend radially outward (i.e., the radial thickness) approximately 0.030" from the outer surface 38 of the sidewall member 20. Given the frustoconically decreasing outside diameter of the hollow sidewall member 20 extending from the first end 36 to the second end 44 thereof, the fins 50 extend from the surface of the hollow sidewall member 20 in an ever increasing amount, thereby providing an outer diameter of the sidewall member (when considering the outer surface of the fins 50) with a diameter of approximately the same as the generally hemispherical member 18, preferably about the entire length of the fins 50. In an alternate embodiment, the protrusions 50 extend out from the sidewall member 20 such that the outer diameter of the outer perimeter of the protrusions 50 is approximately the same as the outer diameter of the generally hemispherical member 18 at a location of the protrusions. This is preferred so that the projectile 10 traverses through the barrel of the gun in an even manner.

In an alternate embodiment, the fins 50 may have a slight curvature as they traverse the length of the hollow sidewall member 20. For example, the fins 50 may curve around approximately 0.0708 revolutions per inch of fin length. Further, in yet another alternate embodiment the fins 50 may be orientated at an angle to a plane of the first end 36 of the sidewall member 20. For example, in one embodiment the fins 50 may be orientated approximately at 99° to a plane of the first end 36 of the sidewall member 20.

As explained above, the shell 12 also comprises a divider or cross member 22 between the hemispherical member 18 and the sidewall member 20. In a preferred embodiment, as shown in FIG. 4, the cross member 22 is an integral component of the sidewall member 20, however, it is understood that the cross member 22 may be an integral component of the hemispherical member 18, or it may be a separate component of the shell 12. As an integral component of the sidewall member 20 the cross member 22 is made of the same material as the sidewall member 20.

Figure 2:
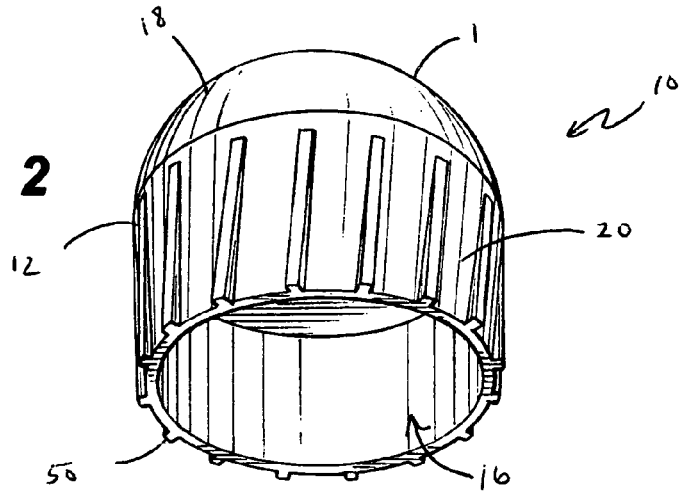
FIG. 2 is bottom perspective view of the aerodynamic projectile of FIG. 1.
Figure 3:
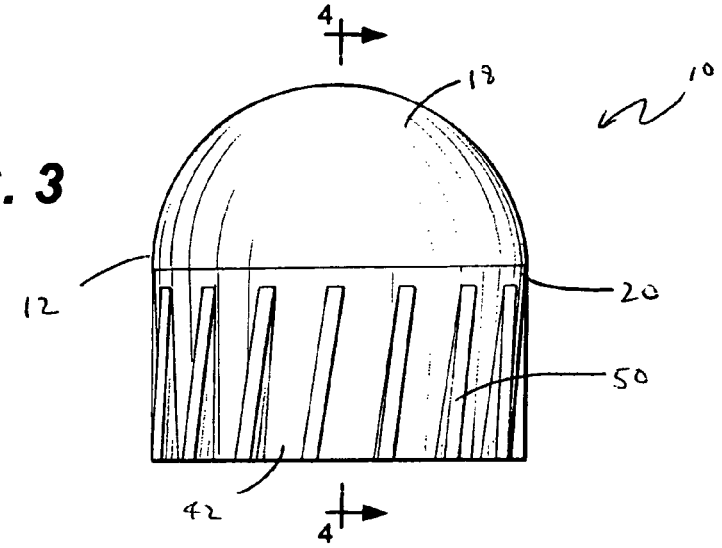
FIG. 3 is a front elevation view of the aerodynamic projectile of FIG. 1.

As shown in FIGS. 2 and 4, the cross member 22 is provided at the first end 36 of the sidewall member 20, and the wall 42 of the sidewall member 20 extends distally away from the cross member 22. The cross member 22 has an first surface 52 that faces outwardly from the sidewall member 20, and a second surface 54 that faces inwardly, toward the inner surface 40 of the wall 42 of the sidewall member 20. Thus, the combination of the second surface 54 of the cross member 22 and the inner surface 40 of the sidewall member 20 define the second open rear cavity 16. As shown in FIG. 4, in one embodiment the rear open cavity 16 is substantially cylindrical in shape, however, the rear open cavity 16 may have an alternate shape without departing from the scope of the present invention. The rear cavity 16 is entirely open as there is no rear wall or other structure closing the second end 44 of the sidewall member 20. And, there is preferably no additional structure radially interior of the sidewall member 20, thereby providing free access to the to the open rear cavity 16. Thus, in one embodiment the sidewall member 20 is hollow. Accordingly, with no rear wall the sidewall member 20 has much less weight than prior projectiles, allowing the center of gravity of the projectile 10 to be located closer toward the front of the projectile 10, and resulting in greater in-flight accuracy of the projectile 10.

Once the hemispherical member 18 and the sidewall member 20 are prepared, they are fixedly joined together, preferably by ultrasonic welding although other suitable techniques, such as solvent welding, may be used employing conventional procedures. The use of such fixing techniques preferably precludes the two members from becoming separated prior to impact.

After the hemispherical member 18 and the sidewall member 20 are joined with the cross member 22 therebetween, the first front closed cavity 14 is complete. The first front closed cavity 14 and interior volume thereof is defined by the combination of the inner surface 26 of the generally hemispherical member 18 and the first surface 52 of the cross member 22. Accordingly, the cross member 22 operates as a divider between the front closed cavity 14 and the rear open cavity 16. In one embodiment the inner volume of the first closed cavity 14 is also generally hemispherical in shape, however, it may also have an alternate geometric configuration. For example, a portion of the interior volume of the first closed cavity 14 adjacent the cross member 22, as shown in FIG. 4, may also have a cylindrical shape.

Following the joining of the two component pieces (i.e., the hemispherical member 18 and the sidewall member 20), fill material 60 may be injected into the interior volume of the front closed cavity 14 through the fill hole 30 (see FIGS. 4 and 6-8). The fill hole 30 is typically sealed after the fill material 60 is inserted into the cavity 14. In an alternate embodiment the closed cavity 14 is preferably filled by inserting an injection needle into the fill hole 30 and having the fill material 60, preferably including the coloring agent and weighing agent, such as a non-toxic vegetable pigment and/or dye dissolved in water and having the appropriate weight and density, injected into the cavity 14. After withdrawing the injection needle, a heat needle or heat sealer is applied to the fill hole 30 thus sealing the hemispherical member 18. Any flashing caused by the joining of the hemispherical member 18 to the sidewall member 20, and the sealing of the fill port 30 is preferably removed from the projectile 10.

In a preferred embodiment the fill material 60 is provided as a marking agent. In one preferred embodiment, such fill material 60 is typically a fluid. The fluid is preferably a weighting agent in combination with a colorant to provide marking capability. The weighting agent is typically required to obtain the desired weight relationship of the projectile 10 to maintain the center of gravity of the projectile 10 in front of the center of pressure of the projectile 10 during flight of the projectile 10. Suitable coloring agents can be liquid or powder pigments and/or dyes. One such suitable coloring agent is a water soluble pigment and/or dye dispersed in water. Such a pigment and/or dye ultimately may be readily washed from the skin and clothing of a victim struck by the identified less lethal projectile 10. This permits the victim to remove the pigment and/or dye after apprehension. Another suitable coloring agent is a permanent pigment and/or dye.

Other suitable coloring agents include pigments and/or dyes which can be detected by infra red or ultraviolet light. Still other suitable coloring agents include pigments and/or dyes which glow in the dark to permit detection of identified individuals who have been marked during day light hours. In cases where the coloring agent is a chemical pigment and/or dye that is not compatible with the shell material, the coloring agent may be placed in miniature glass ampules which are subsequently added to the interior compartment. The use of glass ampules allows even a wider variety of chemicals to be used in combination with various shell materials. The glass ampules are preferably introduced into the closed cavity 14 of the hemispherical member 18 prior to the joining of the hemispherical member 18 and the sidewall member 20. Alternatively or additionally, the portions of the projectile can be further subdivided, e.g., by inserting one or more dividers 22 into the portions.

Alternatively or additionally, the front closed cavity 14 may be filled with an immobilizing component, such as an irritant or other noxious chemical. The irritant or noxious chemical can be in a liquid, powder, or a gaseous state. Suitable irritants include eye irritants, such as pepper powder or tear gas. Suitable noxious agents include such chemicals as malodorants which induce nausea and/or vomiting. As discussed above, any immobilizing component not compatible with the shell material may be placed in miniature glass ampules which are subsequently added to the interior compartment. Various marking and immobilizing agents are identified in U.S. Pat. No. 6,230,630, which is incorporated herein and made a part hereof.

The weighting agent of the fill material 60 may be introduced into the closed cavity 14 of the hemispherical member 18 through the fill port 30 either prior, after or during the introduction of the marking or immobilizing agent. Alternately, the weighting agent portion of the fill material 60 may be composed of the marking agent, such as a dense marking agent.

Regardless of the specific marking or immobilizing agent used, in a preferred embodiment the fill material 60 should have the desired weight relationship with the shell 12 of the projectile 10 to result in a proper flight accuracy. Preferably, the overall weight of the projectile 10, including the shell 12 and the fill material 60, is less than eight grams, and more preferably less than 3.3 grams, however, for alternate purposes they may be heavier.

One such weighting or ballasting agent that is added to the marking agent to provide the appropriate weight for the fill material 60 is barium sulfate, which is preferably added to the marking agent to result in the appropriate marking fill material 60. It is understood that other materials, such as bismuth and tungsten carbide, as well as others, may be utilized to attain the appropriate weight of the fill material. Adding weight to the projectile 10 improves the accuracy and aerodynamic properties of the projectile 10. The weighting agent is added to the fill material 60 in an amount that achieves a center of gravity (Cg) of the projectile 10 positioned forward of the center of pressure (Cp) for the projectile 10 when fired. The center of gravity, which refers to the distribution of mass in the projectile, can be defined as the point at which the projectile would be perfectly balanced if it were suspended with no forces, other than gravity, acting on it. The center of pressure can be defined as the point at which the projectile would be balanced if it were suspended with no forces, other than air pressure, acting on it. Preferably, the fill material 60 is provided such that the center of gravity is positioned as far forward as possible. In one embodiment the center of gravity is located within the closed cavity 14 and forward of the cross member 22, and more preferably approximately 0.08" forward of the weld between the hemispherical member 18 and the sidewall member 20.

To achieve the proper weight distribution such that the center of gravity is forward of the center of pressure of the projectile 10 during flight of the projectile 10, a dense fill material 60 is provided. The amount of weight of the fill material is calculated according to the size and weight of the projectile shell and the desired total weight of the projectile. Specifically, the amount of weighting agent added is that amount which, in combination with the filling material, has sufficient volume to fill the interior cavity 14 and sufficient weight to produce the desired total weight of the projectile, taking into consideration the weight of the projectile shell, such that the center of gravity is forward of the center of pressure during flight of the projectile 10. In one embodiment the shell 12 weighs approximately 0.42 grams, and the fill material 60 weighs approximately 2.6 grams. Most importantly, the distribution of weight in the projectile is necessary to have the center of gravity of the projectile be maintained in front of the center of pressure of the projectile during flight of the projectile.

In order to achieve the center of gravity in front of the center of pressure while still maintaining the proper overall weight required for the application, it is optimal to take as much weight out of the shell 12 as possible. The open back to the open cavity 16 assists in providing such decreased weight for the shell 12. Another means is to have an appropriate density of the fill material 60 in the front closed cavity 14, as explained above. In a preferred embodiment the interior volume of the front closed cavity 14 is approximately 1 $cm^3$. The density of the fill material 60 provided in such a volume is highly important to achieving the center of gravity in front of the center of pressure during flight of the projectile 10*o*. In a preferred embodiment the fill material 60 has a density of approximately 15 lb/gallon of fill material 60. In an alternate preferred embodiment the fill material 60 has a density of at least 15 lb/gallon, and in another preferred embodiment the fill material 60 has a density of greater than 10 lb/gallon. Conversely, typical paintball paint, such as polyethylene glycol, has a density of approximately 8 lb/gallon. Such fill material 60 densities in combination with the weight of the shell 12 achieve the center of gravity in front of the center of pressure of the projectile 10 during its flight to allow the projectile to attain an extremely accurate flight.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention.

What is claimed is:

1. A less lethal projectile comprising:

a shell comprising a generally hemispherical member in a first portion of the projectile, a sidewall member in a second portion of the projectile, and a cross member therebetween, the cross member integrally formed with the sidewall member and consisting of the same material as the sidewall member;

the generally hemispherical member having an outer surface and an inner surface, the inner surface of the generally hemispherical member and a first surface of the cross member defining a closed cavity having an interior volume;

the sidewall member having an inner surface and an outer surface, and a first end abutting the generally hemispherical member and a second end distal the generally hemispherical member, the inner surface of the sidewall member and a second surface of the cross member forming an open cavity opposing the closed cavity of the generally hemispherical member, the open cavity being generally open at the second end of the sidewall; and a fill located within the closed cavity of the generally hemispherical member, the fill having a marking component, and the fill having a density of greater than 10 lb/gallon such that the center of gravity of the projectile is located within the closed cavity.

2. The projectile of claim 1, wherein the sidewall member is generally cylindrical in shape.

3. The projectile of claim 1, further comprising a plurality of protrusions extending from the outer surface of the sidewall member.

4. The projectile of claim 2, wherein the outer surface of the protrusions has approximately the same outer diameter as an outer diameter of the generally hemispherical member.

5. The projectile of claim 2, wherein the protrusions comprise fins.

6. The projectile of claim 5, wherein the fins radially extending from the sidewall member provide a generally outer cylindrical circumference for the sidewall member having approximately the same diameter as the generally hemispherical member.

7. The projectile of claim 1, wherein the sidewall member has a frustoconical shape with a larger outside diameter at the first end of the sidewall member than at the second end of the sidewall member.

8. The projectile of claim 5, wherein the fins are orientated at approximately 99° to a plane of the first end of the sidewall member.

9. The projectile of claim 5, wherein the radial thickness of the fins is approximately 0.03" at their thickest portion adjacent the second end of the sidewall member, and wherein the thickness of the fins decreases toward the first end of the sidewall member.

10. The projectile of claim 1, wherein the generally hemispherical member is fixedly connected to the sidewall member.

11. The projectile of claim 1, wherein the cross member is integral with one of the generally hemispherical member and the sidewall member prior to joining of the generally hemispherical member and the sidewall member.

12. The projectile of claim 1, wherein there is no additional structure radially interior of the sidewall member, thereby providing free access to the open cavity.

13. The projectile of claim 1, wherein the overall weight of the projectile is less than 3.3 grams.

14. The projectile of claim 1, wherein the density of the fill in the closed cavity is approximately at least 15 lb/gallon.

15. The projectile of claim 1, wherein the density of the fill in the closed cavity is approximately 16 to 17 lb/gallon.

16. The projectile of claim 1, wherein a radius of the generally hemispherical portion is approximately equal to a length extending from the first end to the second end of the sidewall member.

17. A projectile comprising:

a shell comprising a generally hemispherical member in a first portion of the projectile, a sidewall member in a second portion of the projectile, and a cross member therebetween, the cross member integrally formed with the sidewall member and consisting of the same material as the sidewall member; the generally hemispherical member having an outer surface and an inner surface, the inner surface of the generally hemispherical member and a first surface of the cross member defining a closed cavity having an interior volume; the sidewall member having an inner surface and an outer surface, and a first end abutting the generally hemispherical member and a second end distal the generally hemispherical member, the inner surface of the sidewall member and a second surface of the cross member forming an open cavity opposing the closed cavity of the generally hemispherical member, the open cavity being generally open at the second end of the sidewall;

a plurality of fins extending radially outward from an outer surface of the sidewall from adjacent the second end of the sidewall toward the first end of the sidewall, the fins having an outer perimeter with approximately a same outer diameter as an outer diameter of the generally hemispherical portion; and a marking agent in the closed cavity such that the center of gravity of the projectile is located within the closed cavity.

18. The projectile of claim 17, wherein the marking agent has a density of greater than 10 lb/gallon.

19. The projectile of claim 17, wherein the interior volume comprises approximately one cubic centimeter.

20. The projectile of claim 17, wherein the fins are orientated at an angle to a plane of the first end of the sidewall.

21. A projectile comprising:

a shell comprising a generally hemispherical member in a first portion of the projectile, a sidewall member in a second portion of the projectile, and a cross member therebetween, the cross member integrally formed with the sidewall member and consisting of the same material as the sidewall member; the generally hemispherical member having an outer surface and an inner surface, the inner surface of the generally hemispherical member and a first surface of the cross member defining a closed cavity having an interior volume; the sidewall member having an inner surface and an outer surface, and a first end abutting the generally hemispherical member and a second end distal the generally hemispherical member, the inner surface of the sidewall member and a second surface of the cross member forming an open cavity opposing the closed cavity of the generally hemispherical member, the open cavity being generally open at the second end of the sidewall;

a plurality of symmetrically spaced fins extending outward from an outer surface of the sidewall at an angle from adjacent the second end of the sidewall toward the first end of the sidewall, the fins having an outer perimeter with approximately a same outer diameter as an outer diameter of the generally hemispherical portion; and a marking fill having a density greater than 10 lb/gallon located within the closed cavity such that the center of gravity of the projectile is located within the closed cavity.

22. The projectile of claim 21, wherein the first closed cavity is generally hemispherical in shape.

23. The projectile of claim 21, wherein the generally hemispherical portion is made of a linear polymer that is molecularly orientated to fracture upon impact of the projectile.

* * * * *